US005622369A

United States Patent [19]

Rogers

[11] Patent Number: 5,622,369

[45] Date of Patent: Apr. 22, 1997

[54] RESILIENT TOSS GAME TARGET

[76] Inventor: James F. Rogers, P.O. Box 723, Dallas, Tex. 75221-0723

[21] Appl. No.: 654,633

[22] Filed: May 29, 1996

[51] Int. Cl.[6] ..... F41J 1/00; A63B 67/00

[52] U.S. Cl. ..... 273/398; 273/342; 273/DIG. 8

[58] Field of Search ..... 273/348, 342, 273/398, 399, 347, 123 R, 344, 400, DIG. 8; 473/278

[56] References Cited

U.S. PATENT DOCUMENTS

| | | | |
|---|---|---|---|
| 659,352 | 10/1900 | Park | 273/347 |
| 713,704 | 11/1902 | Smith | 273/347 |
| 1,315,927 | 9/1919 | Geib | 273/123 R |
| 1,774,765 | 9/1930 | Schoen | 273/344 |
| 2,092,162 | 9/1937 | Hiatt | 273/347 |
| 2,786,683 | 3/1957 | Shapiro | 473/278 |
| 3,051,488 | 8/1962 | Villa | 273/400 X |
| 3,795,401 | 3/1974 | Voltz et al. | 273/1.5 A |
| 3,968,967 | 7/1976 | Nally | 273/342 |
| 4,573,689 | 3/1986 | Sultzbaugh | 273/348 |
| 5,290,041 | 3/1994 | Kettelson | 273/400 |

*Primary Examiner*—William H. Grieb
*Attorney, Agent, or Firm*—Andrew J. Dillon

[57] ABSTRACT

The resilient game target includes a generally planar surface which has multiple cup shaped concave receptacles. Multiple resilient dome-shaped protrusions surround each cup shaped receptacle such that a game piece which strikes a resilient dome-shaped protrusion will be reflected. Multiple target indicia are displayed on the planar surface in association with selected cup-shaped receptacles such that a selected score may be associated with a final resting position of a thrown game piece. The resilient game target is preferably integrally formed of a resilient foam, such as open-cell polyurethane.

14 Claims, 2 Drawing Sheets

10

RESILIENT TOSS GAME TARGET

BACKGROUND OF THE INVENTION

1. Technical Field

The present invention relates in general to games of toss and in particular to games of toss which utilize a target. Still more particularly, the present invention relates to a game of toss utilizing a resilient game target which reflects a thrown game piece in a highly unpredictable manner.

2. Description of the Related Art

Games of toss involving targets and thrown game pieces are well known and numerous in the prior art. Many such games are predicated upon skill and hand-eye coordination and the intentional placement of game pieces within specific areas of a game target. For example, darts, quoits, and other similar games enjoy vast popularity throughout the civilized world.

Similarly, selected games are well known in which the action of the game piece, once tossed, is relatively unpredictable. For example, games such as pin-ball, pachinko and roulette enjoy great popularity despite the absolute inability of the player to accurately predict the flight of the game piece.

Numerous examples of such games exist within the prior art. For example, U.S. Pat. No. 713,704 discloses a parlor game having a target furnished with variously colored spaces set about with concentric rows of spikes wherein the spikes are arranged so as to retain any of a series of similarly colored elastic balls which may be thrown or bounded between the spikes. U.S. Pat. No. 659,352 discloses a similar game of toss in which the target includes a series of pegs which may serve to retain circular game pieces which are tossed at the target.

U.S. Pat. No. 2,092,162, issued to E. B. Hiatt on Sep. 7, 1937 discloses a game of amusement in which balls are thrown at a target wherein the target includes a plurality of wedge-shaped receiving points which are slightly resilient and inclined such that a ball or game piece tossed at the target will be wedged between adjacent pegs and retained in the position in which the ball strikes the target. In this manner, the score associated with a particular ball thrown at the target may be readily determined as the ball will be retained between adjacent resilient spikes.

In view of the above, it should be apparent to the reader that games of toss and/or skill are widely accepted in American homes and serve to amuse both player and the observer of such games.

SUMMARY OF THE INVENTION

It is therefore one object of the present invention to provide an improved game of toss.

It is another object of the present invention to provide an improved game of toss which utilizes a target.

It is yet another object of the present invention to provide an improved game of toss which utilizes a resilient game target which reflects a thrown game piece in a highly unpredictable manner.

The foregoing objects are achieved as is now described. A resilient game target and game piece are disclosed. The resilient game target includes a generally planar surface which has multiple cup shaped concave receptacles. Multiple resilient dome-shaped protrusions surround each cup shaped receptacle such that a game piece which strikes a resilient dome-shaped protrusion will be reflected. Multiple target indicia are displayed on the planar surface in association with selected cup-shaped receptacles such that a selected score may be associated with a final resting position of a thrown game piece. The resilient game target is preferably integrally formed of a resilient foam, such as open-cell polyurethane.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
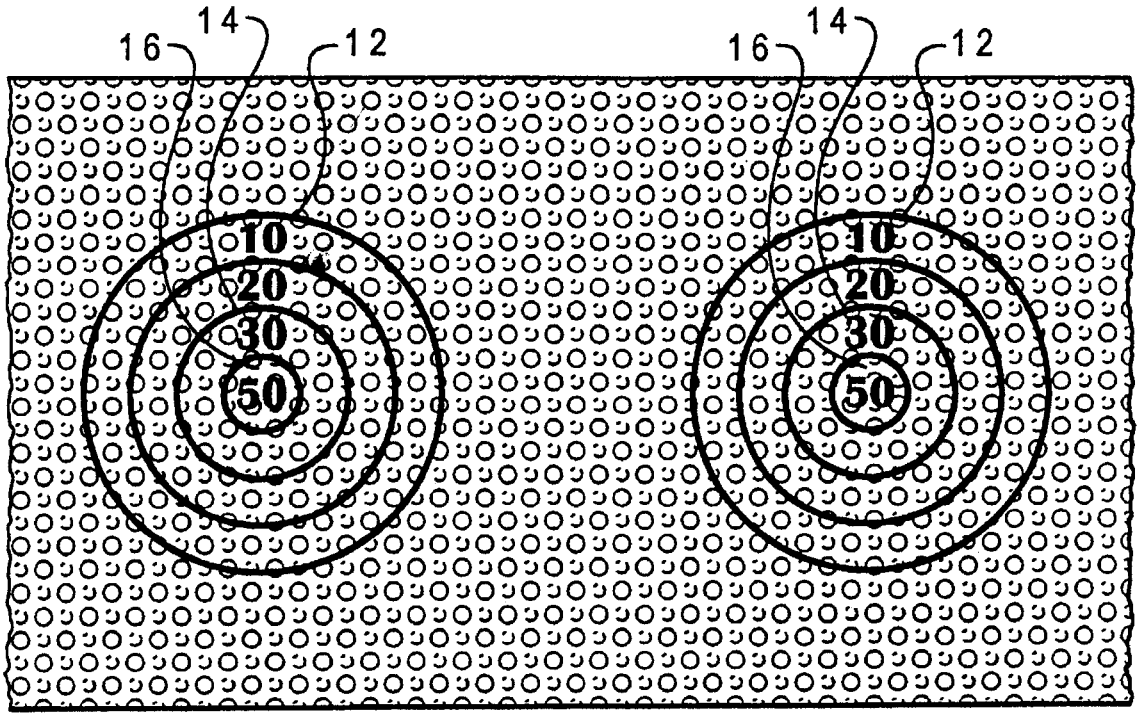
FIG. 1 is a plan view of a resilient target which may be provided in accordance with the present invention.

With reference now to the figures and in particular with reference to FIG. 1, there is depicted a plan view of a resilient target 10 which may be utilized in accordance with the present invention. As illustrated, resilient target 10 comprises an appropriately sized target area which includes multiple protrusions and concave receptacles integrally formed of a resilient foam-like material such as open cell polyurethane foam. As depicted, the upper surface of resilient target 10 includes a plurality of concentric circles in the manner of a bull's eye wherein each concentric circle has a numerical score associated therewith. For example, concentric circle 12 has associated therewith the numeric value "10." Similarly, concentric circles 14 are associated with the numeric value "30" while the center of the bull's eye, as indicated at reference numeral 16, is associated with the numeric value "50."

Although bull's eye targets are illustrated within the depicted embodiment of the present invention those skilled in the art will appreciate that numerous other indicia and scoring characteristics may be associated with a resilient target provided in accordance with the present invention and that the claims appended hereto are intended to contemplate such variations.

Figure 2:
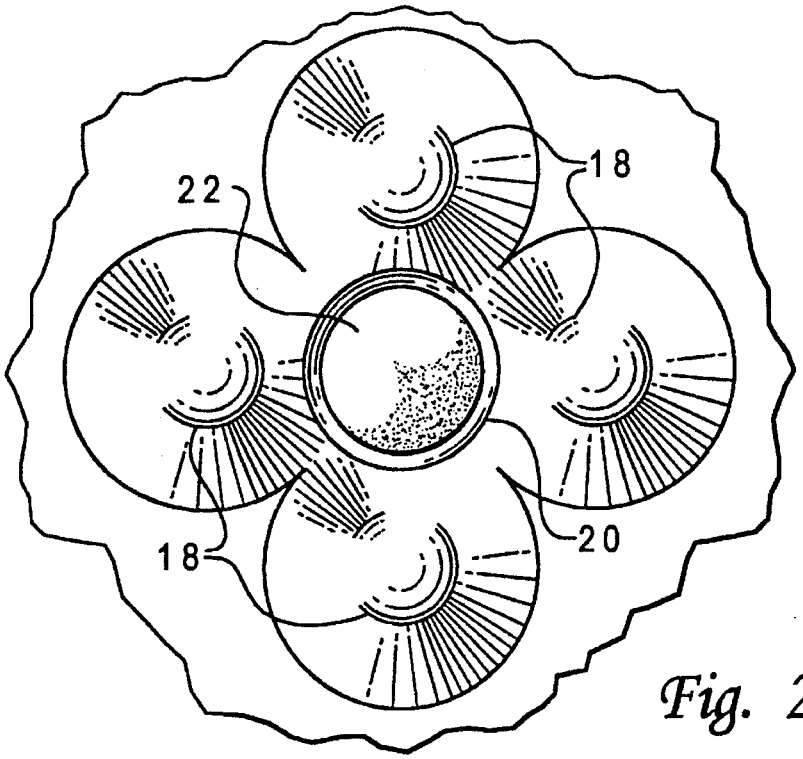
FIG. 2 is an enlarged plan view of a portion of the resilient target of FIG. 1 which illustrates a plurality of resilient dome-shaped protrusions surrounding a cup-shaped receptacle and a spherical game piece.

Referring now to FIG. 2 there is depicted an enlarged plan view of a portion of resilient target 10 of FIG. 1 which depicts a plurality of resilient dome-shaped protrusions 18 which surround a cup-shaped receptacle 20. A spherical game piece 22 is depicted resting within cup-shaped receptacle 20; however, as those skilled in this art will appreciate, game piece 22 may also be a cube, disk, or other shape. Further, as will be explained in greater detail herein, the resilient nature of dome-shaped protrusions 18 and concave receptacle 20 make it difficult to accurately place game piece 22 within a desired cup-shaped receptacle among the many cup-shaped receptacles present within resilient target 10. As described above, resilient target 10, dome-shaped protrusions 18 and cup-shaped receptacle 20 may be integrally formed of a single resilient material such as open cell polyurethane. Those skilled in the art will appreciate that additional resilient materials may be utilized.

Figure 3:
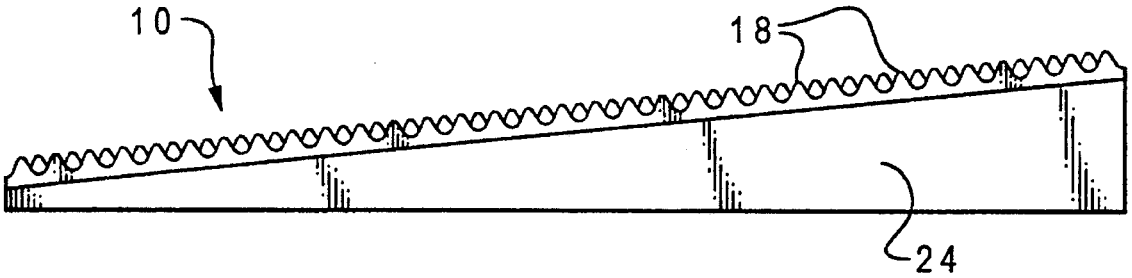
FIG. 3 is a side view of a first embodiment of the resilient target of FIG. 1, featuring an inclined base unit.

With reference now to FIG. 3 there is depicted a side view of a first embodiment of the resilient target 10 of FIG. 1 which includes an inclined base 24. As depicted, resilient target 10 is fixed to inclined base 24 and game pieces may be thrown or launched at resilient target 10 from a direction adjacent to the low end of inclined base 24.

Figure 4:
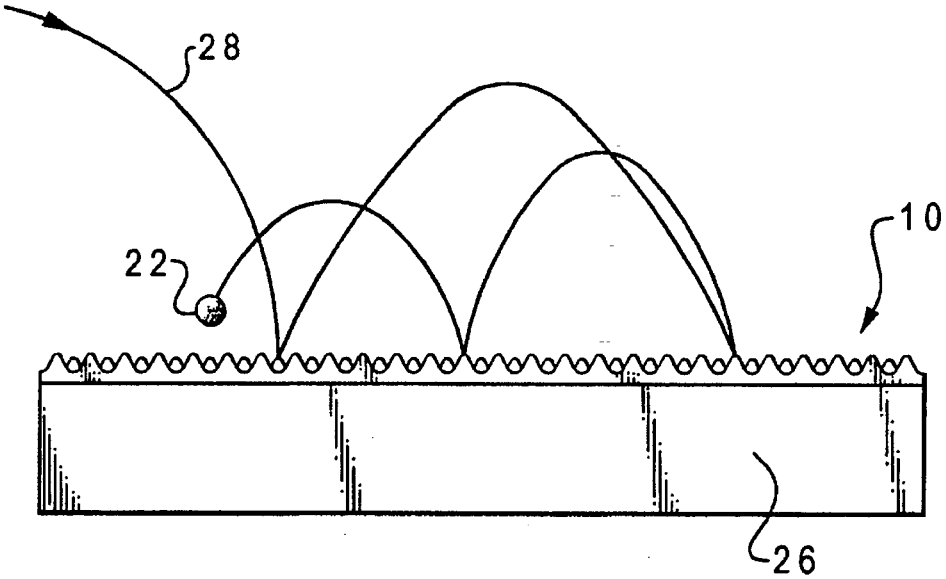
FIG. 4 is a side view of a second embodiment of the resilient target of FIG. 1 which illustrates the action of a thrown game piece.

Finally, referring to FIG. 4 there is depicted a side view of a second embodiment of resilient target 10 of FIG. 1 which includes a horizontal base 26. The flight of game piece 22 is depicted by line 28 and, as graphically depicted within FIG. 4, it may be seen that upon striking resilient target 10, game piece 22 will be reflected in an amusing and highly unpredictable manner prior to coming to eventual rest within a cup-shaped receptacle within resilient target 10. In this manner, children and adults may find amusement in observing the unpredictable reflections of game piece 22 and in attempting to ascertain the final resting place of game piece 22.

While the invention has been particularly shown and described with reference to a preferred embodiment, it will be understood by those skilled in the art that various changes in form and detail may be made therein without departing from the spirit and scope of the invention.

What is claimed is:

1. A game target comprising:

a generally planar surface having a plurality of cup-shaped concave receptacles;

a plurality of resilient dome-shaped protrusions surrounding each of said cup-shaped concave receptacles such that a game piece which strikes a resilient dome-shaped protrusion will be reflected; and target indicia associated with at least one of said plurality of cup-shaped concave receptacles.

2. The game target according to claim 1, wherein said target indicia comprise a plurality of concentric circles, each of said plurality of concentric circles having a numerical score associated therewith.

3. The game target according to claim 2, wherein each of said plurality of concentric circles has a lower score associated therewith than an adjacent smaller concentric circle.

4. The game target according to claim 1, wherein said generally planar surface is resilient in nature.

5. The game target according to claim 4, wherein said generally planar surface and said plurality of resilient dome-shaped protrusions are integrally formed from a single resilient material.

6. The game target according to claim 5, wherein said resilient material comprises a resilient foam.

7. The game according to claim 6 wherein said resilient foam comprises open-cell polyurethane.

8. A game of toss comprising:

a game target comprising:

a generally planar surface having a plurality of cup-shaped concave receptacles;

a plurality of resilient dome-shaped protrusions surrounding each of said cup-shaped concave receptacles such that a game piece which strikes a resilient dome-shaped protrusion will be reflected;

target indicia associated with at least one of said plurality of cup-shaped concave receptacles; and a game piece sized to be received within a single one of said plurality of cup-shaped concave receptacles.

9. The game target according to claim 8, wherein said target indicia comprise a plurality of concentric circles, each of said plurality of concentric circles having a numerical score associated therewith.

10. The game target according to claim 9, wherein each of said plurality of concentric circles has a lower score associated therewith than an adjacent smaller concentric circle.

11. The game target according to claim 8, wherein said generally planar surface is resilient in nature.

12. The game target according to claim 11, wherein said generally planar surface and said plurality of resilient dome-shaped protrusions are integrally formed from a single resilient material.

13. The game target according to claim 12, wherein said resilient material comprises a resilient foam.

14. The game according to claim 13, wherein said resilient foam comprises open-cell polyurethane.

* * * * *